United States Patent [19]

Larkin

[11] 4,382,612

[45] May 10, 1983

[54] ROLLABLE GOLF BAG

[76] Inventor: Sam Larkin, 254 Beach 140th St., Belle Harbor, N.Y. 11694

[21] Appl. No.: 214,129

[22] Filed: Dec. 8, 1980

[51] Int. Cl.[3] ..... B62B 1/20

[52] U.S. Cl. ..... 280/646; 280/655; 403/330

[58] Field of Search ..... 280/DIG. 6, 646, 37, 280/652, 655, 47.19, 47.37 R; 403/308, 375, 330, 261, 290

[56] References Cited

U.S. PATENT DOCUMENTS

| | | | |
|---|---|---|---|
| 2,522,991 | 9/1950 | Caserta | 403/375 |
| 3,985,373 | 10/1976 | Widegren | 280/652 |
| 4,026,595 | 5/1977 | Jacks | 296/15 |
| 4,062,564 | 12/1977 | Schimmeyer | 280/DIG. 6 X |

FOREIGN PATENT DOCUMENTS

| | | | |
|---|---|---|---|
| 469642 | 11/1950 | Canada | 280/DIG. 6 |
| 213238 | 1/1941 | Switzerland | 403/330 |

*Primary Examiner*—Robert J. Spar
*Assistant Examiner*—Donald W. Underwood
*Attorney, Agent, or Firm*—Goodman & Teitelbaum

[57] ABSTRACT

A rollable golf bag having an elongated golf bag container with a collapsible rolling assembly coupled to the container. The collapsible rolling assembly is movable between an extended position to permit rolling of the container, and a folded position to facilitate carrying of the container. Wheels connected on the rolling assembly are detachable and can be stored within a storage compartment of the container.

7 Claims, 9 Drawing Figures

ROLLABLE GOLF BAG

BACKGROUND OF THE INVENTION

This invention relates to golf equipment, and more particularly to a golf bag which can serve as a golf cart.

A golf bag is considered standard equipment for any golfer. Such golf bag typically includes an elongated container which accommodates the length of the golf clubs. The mouth of the golf bag is usually open so that the heads of the golf clubs extend therefrom for easy extraction from the golf bag. Typically, the golf bag includes a hand strap and a shoulder strap to permit carrying of the golf bag.

While the golf bag is convenient for its portability, facilitating carrying around from location to location, it becomes quite heavy and cumbersome when using it on the golf course and carrying it from green to green. As a result, golf carts are frequently used on the golf course where the golf bag is placed in or attached to the golf cart to permit wheeling about of the golf bag during the course of the game. While such golf carts has eased the burden of carrying the golf bag, it requires the need for additional cost in having a separate piece of apparatus, and further requires the need for having two separate pieces of equipment, namely the golf bag and the golf cart. The golfer must therefore transport both items, store them, and continuously manipulate the two separately.

It would be convenient if the golf bag itself would have the ability to be rolled around the golf course. This would of course avoid the need for a separate golf cart. However, the problem then results in storing and carrying of the golf bag itself. With the addition of the extra wheeling equipment, it becomes awkward to carry the golf bags, and it becomes difficult to easily transport it.

There is accordingly a need for a golf bag which can be utilized as a regular golf bag for easy transporting by hand or over the shoulder, as is generally used, and at the same time which will permit wheeling about on the golf course without the need of a separate golf cart.

SUMMARY OF THE INVENTION

It is accordingly an object of the present invention to provide a rollable golf bag which avoids the aforementioned problems of prior art devices.

Another object of the present invention is to provide a rollable golf bag which includes a collapsible rolling assembly to permit wheeling about of the golf bag while at the same time permitting easy carrying of the golf bag.

Still another object of the present invention is to provide a rollable golf bag including a collapsible rolling assembly which can be separated, and various parts thereof stored directly within the golf bag so that the golf bag can be utilized in a standard manner for transportability.

Another object of the present invention is to provide a rollable golf bag having a collapsible rolling assembly which can be moved between an extended position to facilitate rolling about of the golf bag, while it can also be moved into a folded position whereby the golf bag can be used in a standard manner and carried by hand or on the shoulder.

A further object of the present invention is to provide a rollable golf bag having a rolling assembly which can be collapsed so that the wheels are detached and stored in one part of the golf bag, while the wheel supports are collapsed into a folded position adjacent the peripheral side wall of the golf bag.

Briefly, in accordance with the present invention, there is provided a rollable golf bag including an elongated golf bag container, of generally standard shape. A collapsible rolling assembly is coupled to the container for permitting both stationary positioning of the container as well as permitting rolling of the container.

In an embodiment of the invention, the rolling assembly can be moved between an extended position for rolling about of the container, and a folded position for carrying of the container. The rolling assembly includes wheels which can be detached and stored in a storage compartment provided as part of the container itself. A retractable handle can be included to facilitate rolling about of the golf bag container.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DETAILED DESCRIPTION OF THE PREFERRED EMBODIMENT

Figure 1:
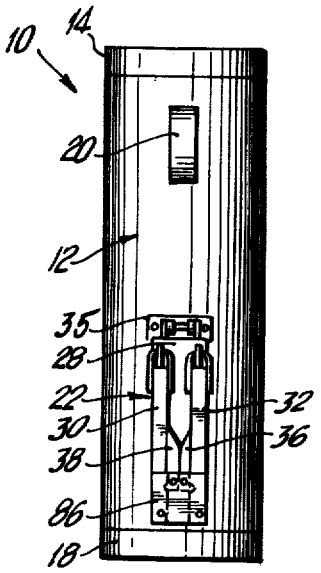
FIG. 1 is an elevational view showing the rollable golf bag of the present invention, and specifically showing the rolling assembly in its folded position.
Figure 2:
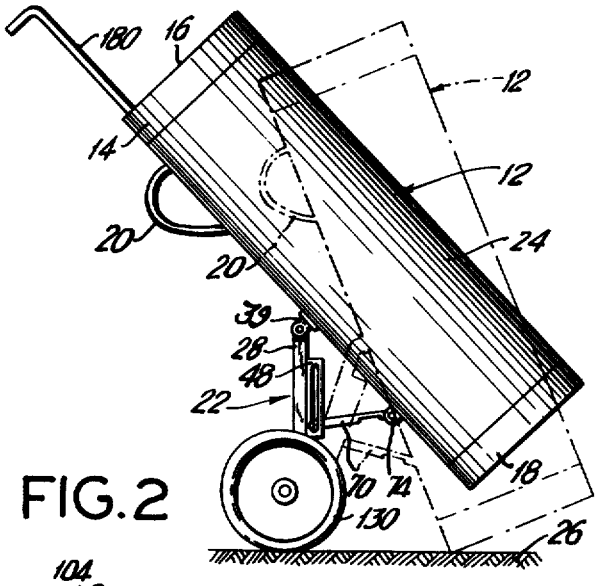
FIG. 2 is a side view showing the golf bag container in a position for rolling about, with the rolling assembly in its extended position.

Referring now to FIGS. 1 and 2, the rollable golf bag of the present invention is shown generally at 10 and includes a golf bag container 12 of generally cylindrical elongated shape, substantially as a conventional golf bag. An upper peripheral stiffening rim 14 surrounds an open mouth 16, while a lower stiffening member 18 defines a rigid base on which the container can stand. A hand strap 20 is provided to facilitate carrying of the golf bag, wherein the conventional shoulder strap is not shown, whereby the shoulder strap is usually releasably attachable to the golf bag by conventional means.

Typically, the golf bag is transported by hand or on the shoulder, and when desired, it is placed on the ground and held in an upright position whereby the golf clubs can be extracted through the open mouth 16 of the golf bag container 12.

In order to permit the golf bag to be rolled about without the need of a separate golf cart, there is provided a collapsible rolling assembly, shown generally at 22, which is mounted onto the rear portion of the peripheral wall 24 of the container 22. The rolling assembly can be moved into a folded position, as shown in FIG. 1, whereby the wheels are removed and stored within the golf bag container, as will hereinafter be explained, and the various support parts of the rolling assembly are folded so as to be adjacent to the peripheral wall 24.

In the folded condition of the rolling assembly, the golf bag can be carried about in standard manner. At the same time, when it is desired to roll the golf bag about, the collapsible rolling assembly can be placed in an extended position, as shown in FIG. 2, and the wheels attached onto the rolling assembly, whereby the golf bag can be tilted and pivoted about the wheels and thereby wheeled about the golf course. It should be noted, that in its folded position, as shown in FIG. 1, the golf bag can stand upright on a support surface by means of its base 18. Similarly, even when the rolling assembly is in its extended position, the golf bag can be placed in a standing position by pivotally moving the golf bag about the wheels so that the base portion 18 rests against a support surface 26, wherein the golf bag is disposed in an angled or inclined position to facilitate the removal of selected golf clubs, as indicated in phantom lines in FIG. 2.

Figure 3:
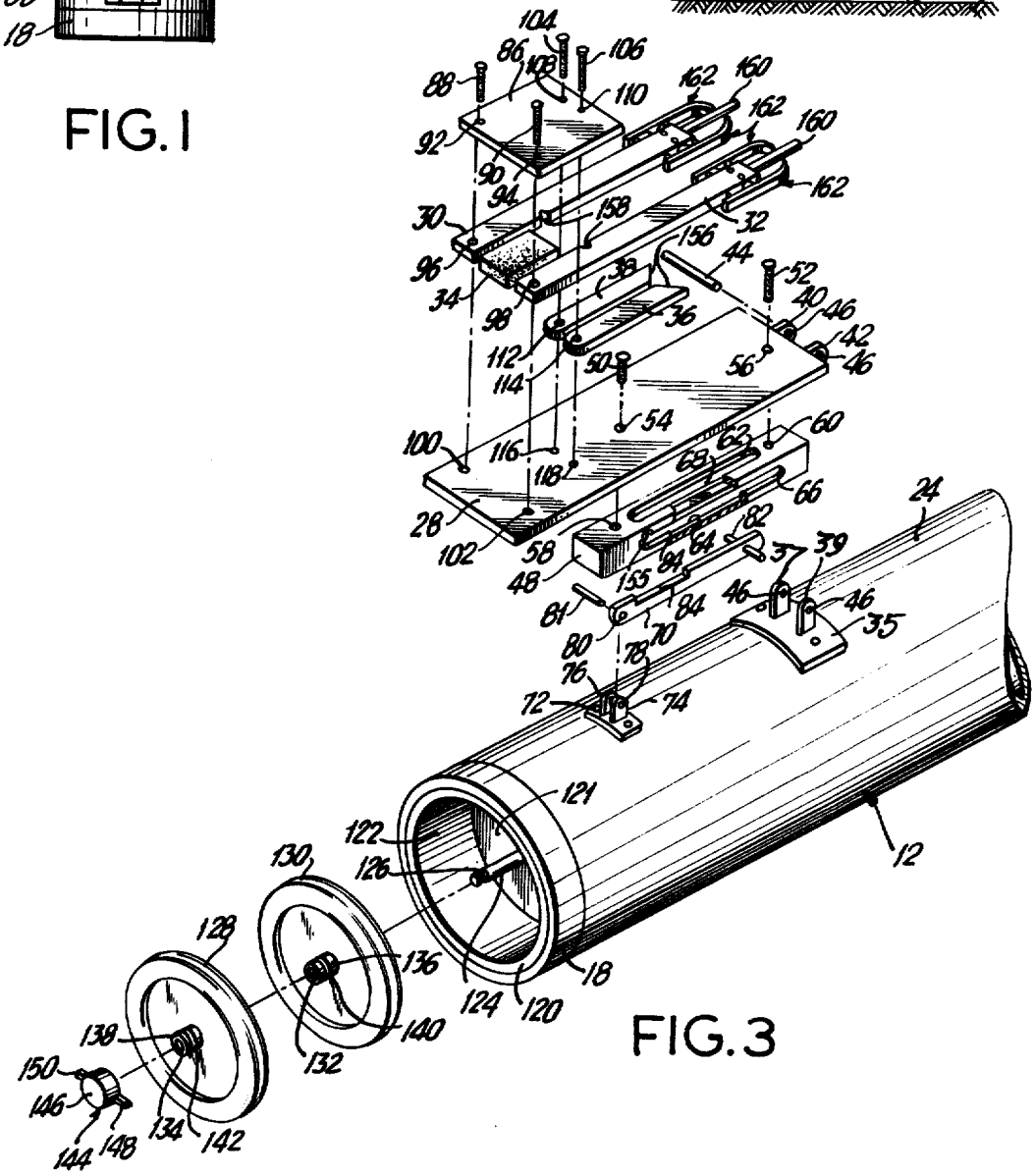
FIG. 3 is a perspective exploded view of the golf bag container in accordance with the present invention.

The collapsible rolling assembly can best be seen in FIG. 3 and includes a substantially rectangular plate member 28 on which are pivotally mounted elongated support arms 30, 32 at their lower ends. The support arms 30, 32 are spaced apart by means of the resilient spacing block 34, which can typically be formed of rubber material. Positioned intermediate the support arms 30, 32 are the locking brackets 36, 38 which are also pivotally connected onto the plate member 28 at their respective lower ends. The plate member itself is hingedly connected onto the peripheral wall 24 of the golf bag container 12 by means of the hinge connection which includes the yoke 35 fastened onto the peripheral wall 24 and the upwardly extending ears 37, 39. Tabs 40, 42 on the plate member 28 are positioned adjacent the ears 37, 39 and the pivot pin 44 passes through axially aligned holes 46 located in the tabs 40, 42 and the ears 37, 39. The pivot pin 44, the ends of which may be peened, hingedly retains the plate onto the container.

A guide member 48 is fastened onto the underside of the plate member 28 by means of the threaded screws 50, 52 which pass through the guide holes 54, 56 in the plate member 28 and are threaded into corresponding aligned holes 58, 60 in the guide member 48. A first pair of transverse slots 62, 64 are formed on the top and bottom confronting walls of the guide member 48, and a second pair of transverse slots 66, 68 are formed on the opposing confronting side walls thereof, so that the slots 62, 64 are perpendicular to the slots 66, 68.

A pivot arm 70 has its lower end pivotally connected onto the peripheral surface 24 by means of a pivot connection which includes the yoke 72 which is longitudinally aligned but spaced below the yoke 35. Upwardly extending ears 74, 76 contain apertures 78 which are aligned with the aperture 80 formed at the lower end of the pivot arm 70. The pivot pin 81 passes through the aligned holes 78, 80 and may be peened at its ends. The pin 81 pivotally connects and retains the pivot arm 70 in place.

At the upper end of the pivot arm 70 there is provided a transverse rod 82. The pivot arm 70 is first inserted into the lower slot 64 formed at the bottom of the guide member 48, and the rod 82 is then inserted through one of the slots 66, 68, through an opening in the arm 70 and then through the other one of the slots 66, 68 so that the rod 82 slides within the slots 66, 68 formed in the confronting side walls as the arm 70 moves in the slot 64. The upper slot 62 permits entry of the top edge of the pivot arm 70 as it slides within the guide member 48, as will hereinafter be explained. A notch 84 is provided at the lower end of the pivot arm 70 to accommodate the thickness of the guide block 48 when in its folded position.

A cover plate 86 is placed on top of the support arms 30, 32 and is held in place by means of the screws or pins 88, 90 which pass through the guide holes 92, 94 in the cover plate as well as the holes 96, 98 in the lower ends of the support arms, and are secured into the plate member 28 through the threaded holes 100, 102. The support arms 30, 32 are thereby pivotally retained onto the plate member by means of these screws or pins 88, 90.

Similarly, the screws or pins 104, 106 pass through corresponding guide holes 108, 110 in the cover plate 86, pass through the guide holes 112, 114 of the locking brackets 36, 38, and are fastened into the threaded apertures 116, 118 in the plate member 28. The locking brackets 36, 38 pivot about the screws 104, 106.

Positioned within the bottom of the golf bag container 12 is an annular receptacle member 120 having a closed end or base wall 121 within the outer trim 18. Both the annular member 120 and the trim 18 can be formed as a unitary piece, or the receptable member can be added onto or extend from the bottom of a conventional golf bag. The space within the annular receptacle member 120 defines a storage compartment 122. An axial shaft 124 is provided in the storage compartment 122, being secured to and extending outwardly from the base wall 121. The shaft 124 includes an annular recess 126 peripherally formed about the shaft.

Two wheels 128, 130 are provided which can be mounted onto the shaft 124 by means of the respective axial bores 132, 134 formed within respective hubs 136, 138 on the respective wheels 128, 130. An annular recess 140, 142 is formed peripherally about each of the hubs 136, 138. A spring lock 144 is also provided, the spring lock including a central housing 146 and laterally extending wings 148, 150. The spring lock 144 latches onto the shaft 124 to hold the wheels 128, 130 in position within the storage compartment 122, as set forth below.

Figure 5:
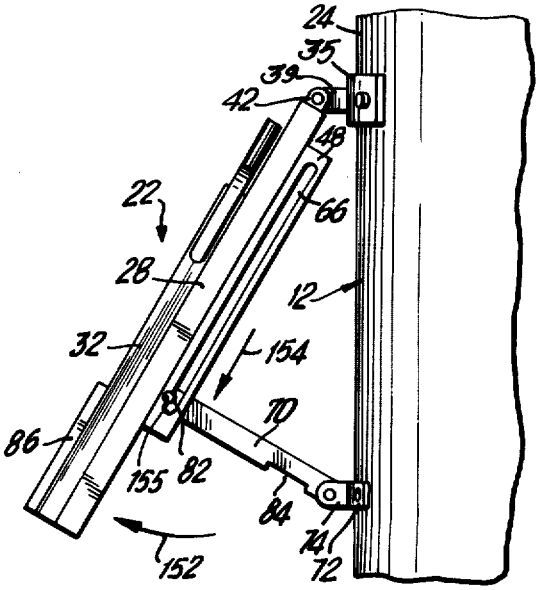
FIG. 5 is a fragmentary side view showing a first step in moving of the rolling assembly into its extended position.

When placing the rolling assembly in its extended position, the plate member 28 is initially pivoted outwardly and upwardly away from the peripheral wall 24, as can best be seen in FIG. 5. The movement of the plate 28 will be in a direction indicated by the arrow 152. At the same time, the rod 82 at the end of the pivot arm 70 will slide downwardly within the elongated slots 66, 68 in the guide member 48 in a direction shown by the arrow 154. The pivot arm will limit the maximum outward angular extension of the plate member 28 and will firmly hold the plate member 28 in its extended position. Preferably, notches or recesses 155 can be provided in the guide member 48 in communication with the lower ends of the slots 66, 68 to receive the pivot arm pin 82 therein to hold the pivot arm 70 in its extended position. However, the weight of the golf bag container will be sufficient, in many cases, to hold the pivot arm 70 in its extended position without the requirement of the notches 155. In such extended position, as shown in FIG. 5, the pivot arm 70 makes a substantially right angle with respect to the plate member 28 to be perpendicular thereto.

Figure 6:
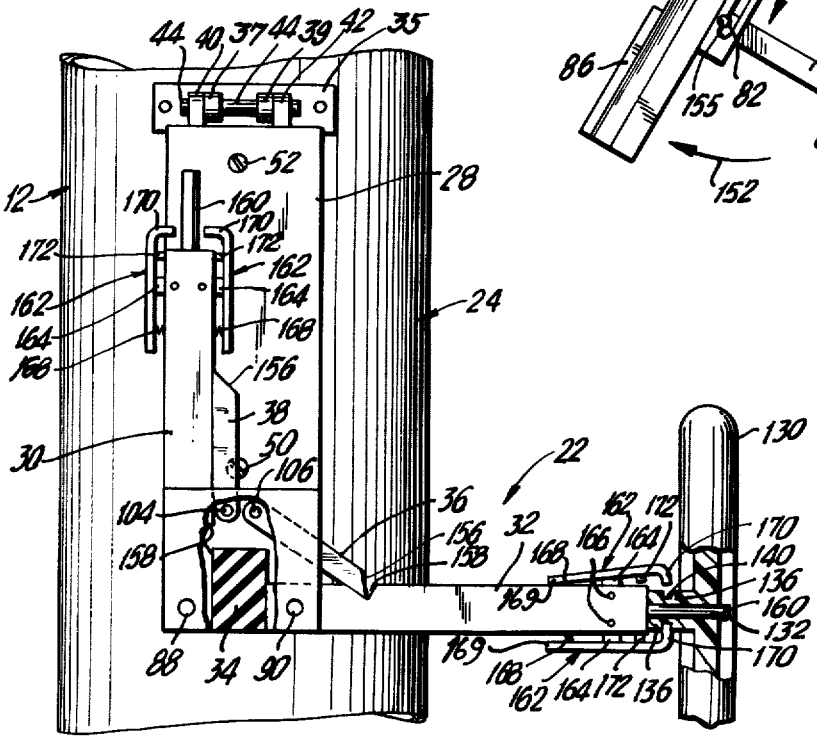
FIG. 6 is a fragmentary rear elevational view, partly in section, and showing a further step in the placing of the rolling assembly to its extended position.

After the plate member 28 has been angularly extended with respect to the peripheral wall, the support arms 30, 32 can be swung from their upwardly aligned position, as shown in FIG. 1, to the outwardly extending position, shown in FIG. 6. With the arm 32 extended, the locking bracket 36 can be rotated downwardly so that the pawl 156 at the end of the bracket 36 will engage a notch 158 formed along the support arm 32. This engagement will lock the support arm 32 in place and prevent it from moving upwardly. A similar pawl 156 and notch 158 arrangement is formed between the locking bracket 38 and the other support arm 30, wherein the support arm 30 is locked in place in the same above manner.

The wheels 128, 130 can then be mounted onto the ends of the support arms. As shown in FIG. 6, a shaft 160 axially extends from the distal end of the support arm 32. Formed on either side of the support arm is a clamp 162, which is pivotally mounted to the arm 32 by means of the pivot bar 164 pinned to the support arm by means of pin 166. A spring 168 biases an inward end 169 of the clamp 162 upwardly so that the clamp 162 is forced into a normally downward position wherein a radially extending tooth 170 on the clamp 162 will engage the annular recess 140 formed in the hub 132 of the wheel 130, as shown by the lower clamp 162 in FIG. 6. A stop 172 is provided on the clamp to prevent excessive downward or inward movement of the clamp. The clamps can be released by pressing downward adjacent their inward end 169 against the biasing spring 168 which will raise the clamp as shown by the upper clamp 162 in FIG. 6, thereby permitting the wheel 130 to be attached to and detached from the support arm. It is understood that the other arm 30 has a similar clamping arrangement to hold the other wheel 128 thereon.

With the rolling assembly in its extended position, and with the wheels attached at the end of the support arms, the golf bag can be rolled about, as shown in FIG. 2. When it is desired to carry the golf bag, the wheels can be removed by releasing the clamps 162 at the end of the support arms 30, 32, then releasing the locking brackets 36, 38 and moving them into their upwardly aligned position, and rotating the support arms 30, 32 into their aligned position.

It should be noted that the resilient member 34 fits between the support arms 30, 32 and is of a size so as to space the arms apart and retain them both in their aligned position, when they are folded, as well as in their horizontally extending position, when they are extended, thereby preventing the pivoting action of the support arms. The flat sides of the support arms will abut the flat sides of the resilient member 34. At the same time, because of its resiliency, upon the application of sufficient force, the resilient member 34 will permit rotation of the support arms between their folded and extended positions by slightly giving during such swinging motion.

Figure 4:
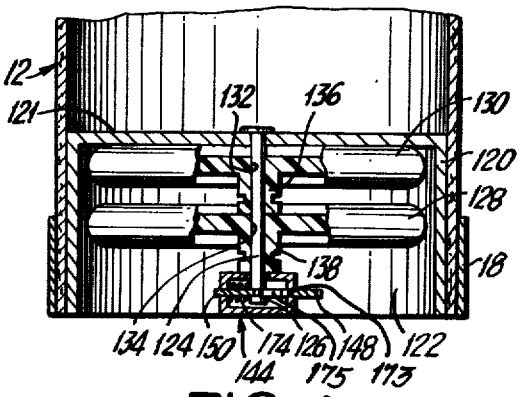
FIG. 4 is a fragmentary sectional view of the bottom part of the golf bag container showing the storage compartment for the wheels.

When the wheels are removed, they can be stored in the bottom storage compartment provided in the golf bag container, or in a storage compartment added onto the bottom of the golf bag. As can best be seen in FIGS. 3 and 4, the wheels can be placed on the axially extending shaft 124 contained within the compartment 122. The hubs 136, 138 will cause the wheel rims to be spaced apart from each other and prevent them from banging against each other. The spring lock 144 is then mounted onto the shaft 124. The wings 148, 150 are shown to be interconnected by a hub 173 which is retained by its size within the housing 146, thereby defining an opening 175 therein for receiving the shaft 124 therethrough. A spring 174 is mounted on the wing 150, the spring 174 being positioned between the hub 173 and the inner walls of the housing 146. Normally, the spring 174 biases the interconnecting hub so that the wing 150 is forced into engagement with the annular recess 126 on the shaft 124 when the shaft 124 is in the opening 175, as shown in FIG. 4. This will clamp the wheels in place and hold them on the shaft 124 within the storage compartment 122. In order to release the spring lock 144, the wing 148 is radially pressed inwardly against the force of the biasing spring 174 to transversely move the hub 173 relative to the shaft 124 so that the opening 175 is in alignment with the shaft 124, thus releasing the wing 150 from the annular recess 126 of the shaft 124, thereby permitting removal of the spring lock and the wheels 128, 130.

It should be noted that the annular member 120 at the bottom of the container 12 is shown to include the base wall 121 in order to form the compartment. However other arrangements can be had whereby the bottom of the golf bag container itself can form the base wall of the compartment. In order to facilitate matters, the height of the storage compartment is made larger than the thickness of the wheels. The spring lock provides a tight fit against the wheels and prevents them from rattling about in the compartment. At the same time, the spring lock is such that it will be either flush, or slightly upward from the support surface, so that the golf bag can be positioned flat in an upright position on the support surface.

Figure 7:
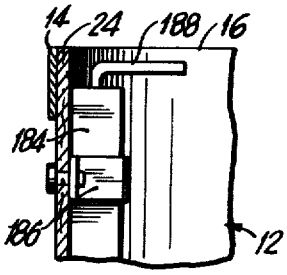
FIG. 7 is a fragmentary sectional view of an upper part of the golf bag container, showing the handle in a retracted position.
Figure 8:
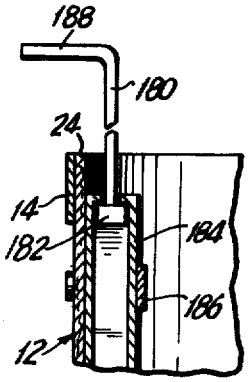
FIG. 8 is also a fragmentary sectional view of the upper part of the golf bag container, showing the handle in its extended position.

In order to facilitate rolling about of the golf bag, a handle 180 is provided. The handle is shown to be an L-shaped member, as can be seen in FIGS. 2, 7 and 8. The handle includes a foot portion 182 which has a friction fit within the sleeve 184. The foot portion 182 can be moved upwardly and downwardly within the sleeve, but is prevented from being removed from within the sleeve by an end flange portion of the sleeve. The sleeve itself is held internally of the bag by means of a clamp 186, which is secured to the bag by fastening means, such as screws. The handle can be moved downwardly into the sleeve and the upper end of the handle 188 can be turned inwardly of the container, as shown in FIG. 7. When desired to be rolled about, the upper end of the handle 188 is rotated and the handle is extracted, as shown in FIG. 8. Because of the friction fit, the handle will securely remain both in its extended and retracted positions. Of course, variations can be made to hold the handle in various positions, as desired.

Figure 9:
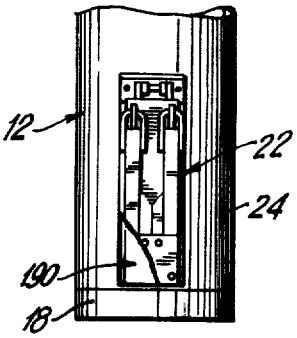
FIG. 9 is a fragmentary rear elevational view of the golf bag container partly broken away, showing another embodiment for connecting the collapsible rolling assembly to the container.

The collapsible rolling assembly can be attached directly to the outer peripheral wall of the golf bag container as shown in FIG. 1. Alternately, as shown in FIG. 9, a recess 190 can be formed in the wall 24 of the golf bag container 12 and the collapsible rolling assembly 22 can be mounted into the recess so that in its folded position it will not extend outwardly from the periphery of the golf bag container.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A rollable golf bag comprising:

a golf bag container;

collapsible rolling assembly means coupled to said container for permitting both stationary positioning as well as rolling of the container;

said rolling assembly means including a plate member hingedly coupled to a peripheral wall of said container, said plate member being rotatable between a folded position adjacent the peripheral wall and an extended position angularly oriented in a downward direction from the peripheral wall;

two support arms peripherally coupled to said plate member and respectively swingable between a vertically aligned retracted position and a laterally outwardly directed extended position;

a respective wheel detachably coupled to a remote end of each support arm;

two locking brackets pivotally connected to said plate member intermediate said support arms and respectively swingable between a vertically aligned folded position and an angularly oriented downwardly directed extended position;

a notch respectively located on each support arm; and a pawl at an end of each bracket for engaging a respective notch to thereby retain said support arms in their respective extended positions.

2. A rollable golf bag comprising:

a golf bag container;

collapsible rolling assembly means coupled to said container for permitting both stationary positioning as well as rolling of the container;

said rolling assembly means including a plate member hingedly coupled to a peripheral wall of said container, said plate member being rotatable between a folded position adjacent the peripheral wall and an extended position angularly oriented in a downward direction from the peripheral wall;

two support arms peripherally coupled to said plate member and respectively swingable between a vertically aligned retracted position and a laterally outwardly directed extended position;

a respective wheel detachably coupled to a remote end of each support arm; and a resilient block mounted on said plate member and spaced between said support arms to spacially retain the support arms in both their extended and folded positions, while permitting rotation of the support arms between said two positions.

3. A rollable golf bag comprising:

a golf bag container;

collapsible rolling assembly means coupled to said container for permitting both stationary positioning as well as rolling of the container;

said rolling assembly means including a plate member hingedly coupled to a peripheral wall of said container, said plate member being rotatable between a folded position adjacent the peripheral wall and an extended position angularly oriented in a downward direction from the peripheral wall;

two support arms peripherally coupled to said plate member and respectively swingable between a vertically aligned retracted position and a laterally outwardly directed extended position;

a respective wheel detachably coupled to a remote end of each support arm, each wheel including an axially extending hub, an annular recess provided peripherally about each hub, an axial mounting bore through each hub;

each support arm including a mounting shaft axially extending from said remote end of each support arm; and at least one spring biased clamp mounted on each support arm, each clamp having a radially directed tooth for engaging said annular recess of a respective one of said hubs to retain the respective wheel onto the support arm.

4. A rollable golf bag as in claims 1, 2 or 3 and further comprising a brace assembly for limiting movement of said plate member with respect to the peripheral wall, said brace assembly including a brace arm pivotally coupled to said peripheral wall at a spaced location from the hinge coupling of the plate member, a guide member having guide slots and being coupled to an underside of said plate member, and a pin provided at a distal end of said brace arm and slidably disposed in said guide slots.

5. A rollable golf bag as in claims 1, 2 or 3, and further comprising a retractable handle mounted onto said container for pulling the container.

6. A rollable golf bag as in claim 5, wherein said container has an open mouth, and further including a sleeve mounted internally of said container, said handle being slidably located within said sleeve and being accessible through said mouth, and means for retaining said handle in its extended and retracted positions.

7. A rollable golf bag as in claims 1, 2 or 3, wherein said golf bag includes a base wall, a recess provided in said base wall, and wherein said wheels are mounted within said recess in a storage position when said wheels are detached from said support arms.

* * * * *